US008899502B2

(12) United States Patent
Lehtonen et al.

(10) Patent No.: US 8,899,502 B2
(45) Date of Patent: Dec. 2, 2014

(54) CRUSHER AND CONTROL METHOD FOR A CRUSHER

(75) Inventors: Tommi Lehtonen, Tampere (FI); Tapio J Potila, Pirkkala (FI)

(73) Assignee: Metso Minerals Inc., Helsinki (FI)

( * ) Notice: Subject to any disclaimer, the term of this patent is extended or adjusted under 35 U.S.C. 154(b) by 328 days.

(21) Appl. No.: 12/450,609

(22) PCT Filed: Apr. 5, 2007

(86) PCT No.: PCT/FI2007/050193

§ 371 (c)(1),
(2), (4) Date: Nov. 4, 2009

(87) PCT Pub. No.: WO2008/122689

PCT Pub. Date: Oct. 16, 2008

(65) Prior Publication Data

US 2010/0059610 A1 Mar. 11, 2010

(51) Int. Cl.
*B02C 25/00* (2006.01)
*B02C 2/04* (2006.01)

(52) U.S. Cl.
CPC ..... *B02C 2/047* (2013.01); *B02C 25/00* (2013.01)
USPC ..... 241/30; 241/36; 241/207

(58) Field of Classification Search
USPC ..... 241/36, 207, 30
See application file for complete search history.

(56) References Cited

U.S. PATENT DOCUMENTS

| | | | | |
|---|---|---|---|---|
| 4,723,716 | A | 2/1988 | Hagiwara et al. | |
| 5,718,391 | A | 2/1998 | Musil | |
| 6,213,418 | B1 | 4/2001 | Gabriel et al. | |
| 7,108,208 | B2 * | 9/2006 | Nilsson et al. | 241/36 |
| 7,279,037 | B2 * | 10/2007 | Nemeh et al. | 106/468 |
| 7,591,437 | B2 * | 9/2009 | Nilsson et al. | 241/30 |
| 7,942,358 | B2 * | 5/2011 | Posti et al. | 241/300 |
| 2005/0061897 | A1 | 3/2005 | Lipowski | |
| 2006/0006259 | A1 * | 1/2006 | Jonkka et al. | 241/92 |

FOREIGN PATENT DOCUMENTS

| | | |
|---|---|---|
| JP | A-5435460 | 3/1979 |
| JP | 56-45766 | 4/1981 |
| JP | A-6271554 | 2/1987 |
| JP | 05-063646 | 8/1993 |
| JP | A-10272375 | 10/1998 |
| JP | 2002-346427 | 12/2002 |
| JP | 2005-040793 | 2/2005 |
| WO | WO 2005/007293 A1 | 1/2005 |
| WO | WO 2008/001403 A1 | 1/2008 |

OTHER PUBLICATIONS

Jul. 30, 2012 Office Action issued in Japanese Application No. 2010-501538 (with translation).

* cited by examiner

*Primary Examiner* — Mark Rosenbaum
(74) *Attorney, Agent, or Firm* — Oliff PLC

(57) ABSTRACT

A method for controlling the crusher, which crusher includes at least a frame, a crushing means with a cycle, as well as an actuator for moving the crushing means. In the method, at least first data is determined, which is at least one of the following: the power input in the actuator, the crushing force, the particle distribution of the crushed material produced by the crusher, or the quantity of crushed material produced by the crusher. The cycle frequency of the crushing means is controlled on the basis of the first data. The invention also relates to a crusher, in which the cycle frequency of the crushing means is adjusted according to control data from the control unit.

8 Claims, 7 Drawing Sheets

CRUSHER AND CONTROL METHOD FOR A CRUSHER

FIELD OF THE INVENTION

The invention relates to a crusher and to a method for controlling a crusher.

BACKGROUND OF THE INVENTION

The invention relates to crushers and preferably cone and gyratory crushers, but the arrangement can also be used in other crushers, such as impact and jaw crushers. Typically, cone and gyratory crushers are used for intermediate and fine crushing of material, such as rock. Cone crushers comprise a vertical eccentric shaft and an oblique inner hole fitted therein. A main shaft, to which a supporting cone is often fastened, is fitted in the hole. The supporting cone is surrounded by the frame of the crusher, to which has been mounted a means called an outer crushing blade and functioning as a wearing part. To the supporting cone, in turn, has been mounted a means called an inner crushing blade and used as a wearing part. The inner crushing blade and the outer crushing blade together form a crushing chamber, in which the feed material is crushed. When the eccentric shaft is rotated, the main shaft and thereby the supporting cone are entrained in an oscillating motion, wherein the gap between the inner and outer crushing blades varies at each point during the cycle. The smallest gap occurring during the cycle is called the setting of the crusher, and the difference between the maximum and the minimum of the gap is called the stroke of the crusher. By the crusher setting and the crusher stroke it is possible to influence, among other things, the grain size distribution of the crushed material and the production capacity of the crusher.

The main shaft of a typical cone crusher is bearing-mounted below the crushing cone only. In some crushers, the main shaft of the crusher is further supported at its upper end to the frame by means of an upper thrust bearing. It is this subtype of a cone crusher that is normally called a gyratory crusher.

To increase the efficiency of the crushing process and the utilization degree of the crusher, the operation of the crusher must be adjusted, as the quality and quantity of the material to be crushed vary. In typical cone crushers, the operation is adjusted by controlling the settings of the blades of the crusher. In solutions of prior art, the settings are adjusted on the basis of the power consumption (input power) and/or the crushing force. However, such an adjustment of the crusher is difficult or is not necessarily possible at all in crushers in which long strokes are used.

The gyratory crusher can normally be adjusted by means of a hydraulic system in such a way that the main shaft can be moved in the vertical direction with respect to the frame of the crusher. This makes it possible to change the setting of the crusher in such a way that the grain size of the crushed material corresponds to the grain size desired at each time, and/or to keep the setting constant as the crushing blades are worn. In cone crushers of other types, the adjustment may also be made by lifting and lowering the upper frame of the crusher and the crushing blade mounted on it, in relation to the lower frame of the crusher and the main shaft which is stationary with respect to the lower frame in the vertical direction.

It has also been found that the adjustment of the settings made on the basis of the power consumption and/or the crushing force cannot be used to influence the grain size of the crushed material in a desired way. For example, the adjustment has influenced small grain sizes more strongly and larger grain sizes less strongly. For this reason, there has been a need for the further development of control arrangements.

BRIEF SUMMARY OF THE INVENTION

Now, a solution has been found for controlling the crusher so that it is possible to keep the efficiency of the crushing process and the utilization degree of the crusher at a high level, and the solution is applicable for crushers with different strokes.

Below in this description, the term cone crusher will be used to refer to all crushers, in which material is crushed by means of a cone, irrespective of the method of supporting the cone and its shaft. In this context, a cone crusher will be used as an example crusher, but the solution to be presented can also be applied in other crushers, such as impact crushers and jaw crushers. Thus, the crushing of the material is effected by another crushing means than a crushing cone. In the description, however, the arrangements relating to the crushing cone can also be applied in other movable crushing means.

In one embodiment of the invention, the idea is to control the speed, or frequency, of the cycle of the crushing means in the crusher, for example the crushing cone, on the basis of the power input in the actuator moving the crushing cone, and/or the crushing force of the crusher.

In another embodiment of the invention, the idea is to control the cycle frequency of the crushing means of the crusher on the basis of the particle distribution in the crushed material produced by the crusher.

In one embodiment of the invention, the idea is to control the cycle frequency of the crushing means of the crusher on the basis of the quantity of the crushed material produced by the crusher.

In one embodiment of the invention, the crusher comprises at least a frame, a crushing means and an actuator for moving the crushing means. Furthermore, the crusher comprises measuring devices for measuring the power input in the actuator and/or the crushing force. The crusher also comprises a control unit for processing measurement data and for generating control data. The control data is used for controlling an adjusting device for adjusting the cycle frequency of the crushing means.

In the method according to one embodiment of the invention, in turn, the power input in the actuator and/or the crushing force are determined, and this data is used for controlling the cycle frequency of the crushing means. In one embodiment, the cycle frequency is adjusted by controlling the rotation speed of the actuator.

There is such a cycle frequency for the crushing means of the crusher, at which maximum productivity and utilization degree can be achieved with the power available. This cycle frequency depends, among other things, on the quality and the input rate of the material to be crushed. The cycle frequency is also affected by the grain size aimed at, as well as the settings of the crusher.

In some applications, the aim is to determine the lowest cycle frequency of the crushing means possible with the power input of the crusher, in order to achieve a maximum production of crushed material.

In one embodiment, the power input in the actuator and/or the crushing force is determined continuously, and the cycle frequency of the crushing means is controlled continuously.

In one embodiment, the frequency of the crusher is adjusted to adjust the particle size distribution of the crushed material. The particle size distribution of the crushed material is adjusted as desired by operating the crusher at various frequencies.

In one embodiment, the cycle frequency of the crushing means is adjusted by a frequency converter affecting the rotation speed of the actuator.

In an embodiment, in which the adjustment of the cycle frequency of the crushing means is performed continuously, it is possible to achieve maximum production and utilization degree even if the quality and/or quantity of the material to be crushed varied to a great extent within a short time.

Furthermore, the arrangement of adjusting the frequency is substantially not dependent of the stroke of the crusher. Thus, the adjusting arrangement according to the invention can be applied in various crushers, such as, for example, crushers with long and short strokes.

The solution of adjusting the frequency of the crushing means can also be combined with other control arrangements, such as the adjustment of the settings. In one embodiment, the cycle frequency of the crushing means is changed, if necessary, to correspond to the changed settings.

DESCRIPTION OF THE DRAWINGS

In the following, the invention will be described in more detail with reference to the appended principle drawings, in which.

For the sake of clarity, the figures only show the details necessary for understanding the invention. The structures and details that are not necessary for understanding the invention but are obvious for anyone skilled in the art have been omitted from the figures in order to emphasize the characteristics of the invention.

DETAILED DESCRIPTION OF THE INVENTION

The invention will be described in more detail by using a cone crusher as an example, but the arrangement to be presented can also be applied to other crushers, such as impact crushers and jaw crushers. In the description, however, the arrangements relating to the crushing cone can also be applied to other movable crushing means, such as the crushing jaws of a jaw crusher.

Figure 1:
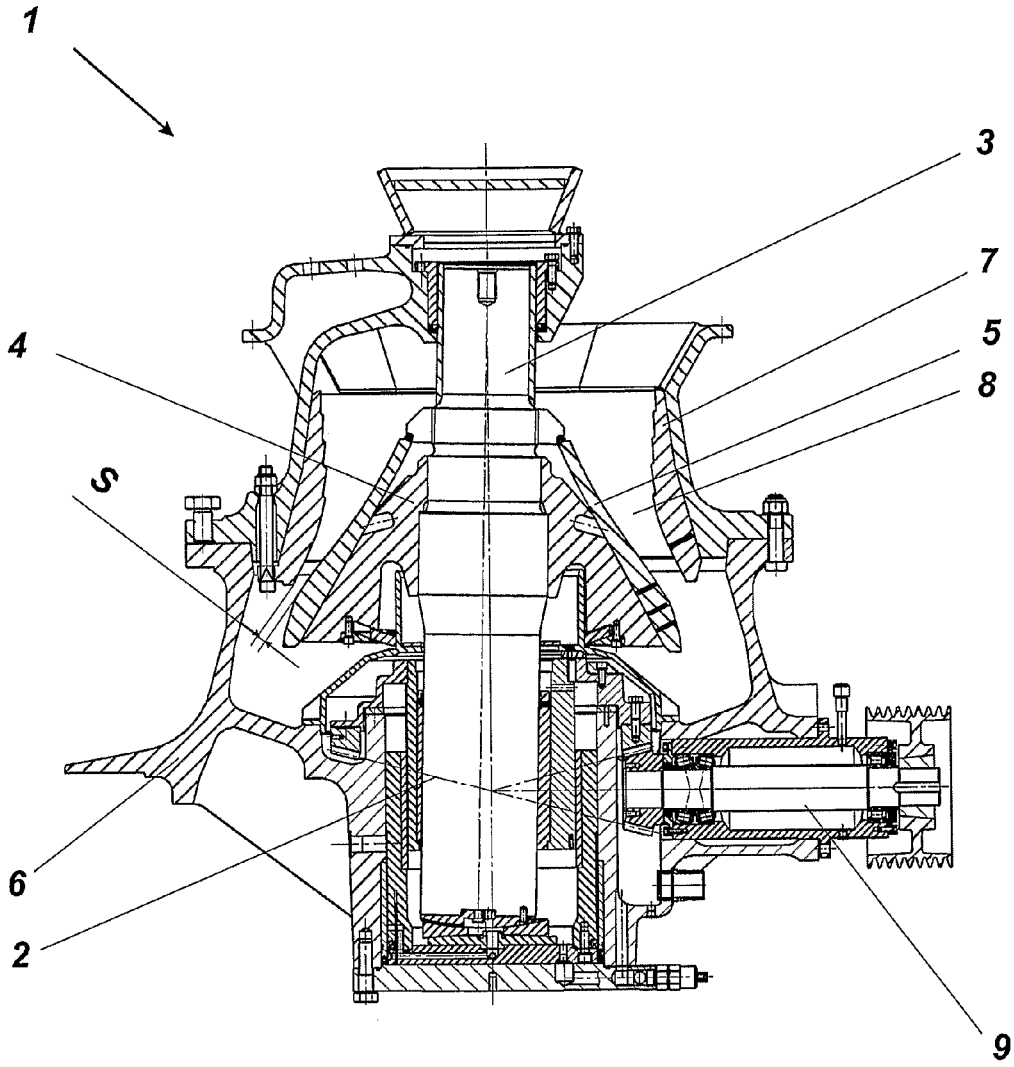
FIG. 1 shows a crushing unit of a gyratory crusher.

A cone crusher unit 1 shown in FIG. 1 comprises a vertical eccentric shaft 2 and an oblique inner hole fitted therein. A main shaft 3 is fitted in the hole inside the eccentric shaft 2, and a supporting cone 4 is often mounted on the main shaft 3. A means called an inner crushing blade 5 and used as a wearing part has been mounted to the supporting cone 4. The supporting cone 4 is surrounded by the frame 6 of the crusher, on which has, in turn, been mounted a means called an outer crushing blade 7 and functioning as a wearing part. The inner and outer crushing blades 5, 7 together form a crushing chamber 8, in which the feed material is crushed. When the eccentric shaft 2 is rotated, the main shaft 3 and thereby the supporting cone 4 are entrained in an oscillating motion, wherein the gap between the inner crushing blade 5 and the outer crushing blade 7 varies at each point during the cycle. The smallest gap occurring during the cycle is called the setting S of the crusher, and the difference between the maximum and the minimum of the gap is called the stroke of the crusher. By the crusher setting S and the crusher stroke, as well as the operating speed of the crusher, it is possible, among other things, to influence the grain size distribution of the crushed material and the production capacity of the crusher.

In this description, the term "cycle frequency" is used to define how fast the gap between the inner crushing blade 5 and the outer crushing blade 7 varies at each point. For example, when the frequency is 60, the inner crushing blade 5 moves 60 times per second between the extreme positions of its path; in other words, there are 3600 cycles per minute.

Figure 2:
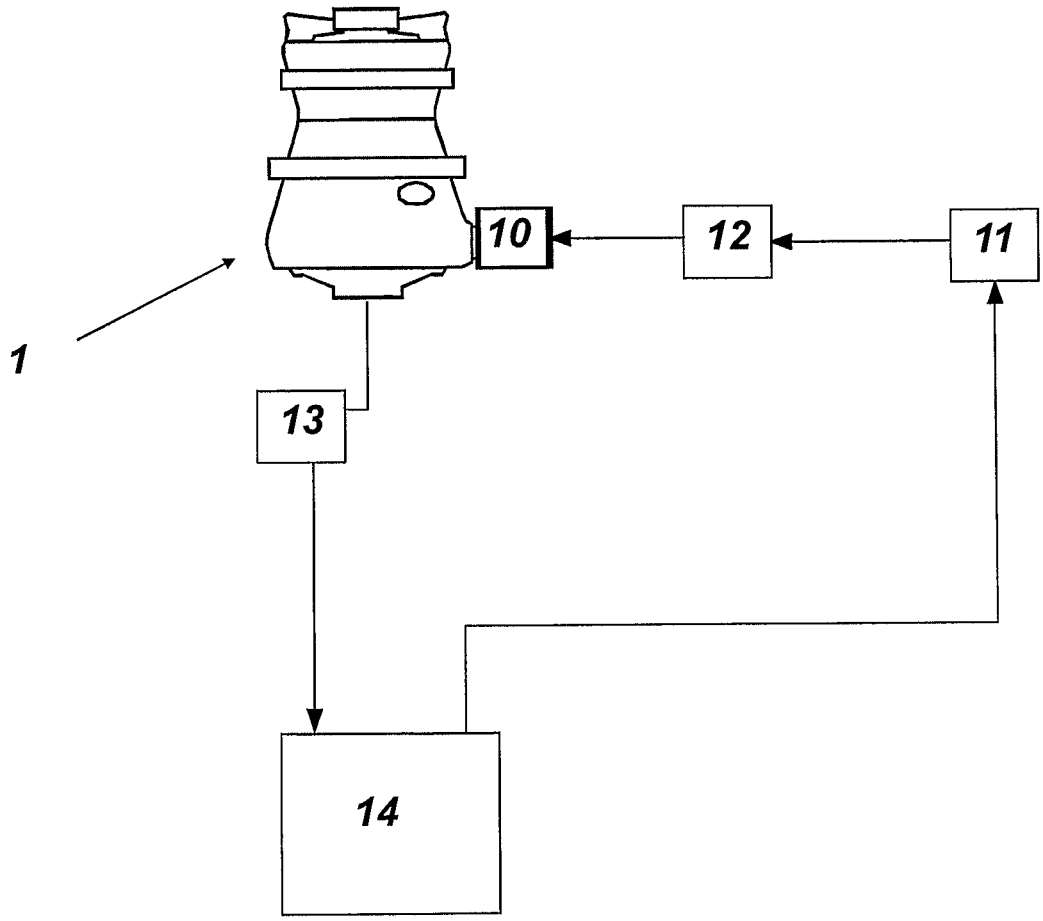
FIG. 2 shows the main idea of a crusher according to the invention in a reduced view.

FIG. 2 shows an actuator 10, such as an electric motor, which produces the motion energy required by the crushing unit 1. In the arrangement of FIG. 1, the movement of the actuator 10 is transmitted by a drive shaft 9 to the eccentric shaft 2. In the example, the actuator 10 receives input from an adjusting device 11 which can be used to affect the rotation speed of the actuator. In an advantageous embodiment, the adjusting device 11 is a frequency converter which is used to influence the frequency of the alternating current to be supplied to the actuator 10 and thereby the rotation speed of the electric motor.

FIG. 2 also shows, in principle, a first measuring device 12 for measuring the power input in the actuator 10, as well as a second measuring device 13 for measuring the crushing force. The measuring devices 12, 13 can be implemented in a variety of ways. For example, if the actuator 10 is an electric motor, power measurement or current measurement can be utilized for measuring the electric power input in it. Also, the placement of the measuring devices 12, 13 is dependent on the application. For example, the power of the actuator 10 can be measured before or after the control unit 11. In one embodiment, the power measurement 12 is arranged in connection with the control unit 11.

Furthermore, the crushing force can be determined and measured in a variety of ways and at different locations, depending on the application. In some crushers, the crushing force can be determined by means of devices used for adjusting the setting. For example, the crushing force of a gyratory crusher can be determined by measuring the pressure of the control cylinder. Also, a cone crusher can be provided with a cylinder whose pressure is proportional to the crushing force. The crushing force can also be measured by measuring the stress. For example, pressure measuring devices or stress measuring devices can be used as the measuring devices 13.

It is also possible that the measuring devices 12, 13 consist of several measurement sensors which possibly measure different variables. The data from these measurement sensors is used for generating the data indicating the power input in the actuator 10 and/or the crushing force.

FIG. 2 also shows a control unit 14, to which the data from the first measuring device 12 and/or the second measuring device 13 is transferred. The control unit 14 processes measurement data from the first measuring device 12 and/or the second measuring device 13, preferably by software. On the basis of the data, the control unit 14 generates control data for controlling the adjusting device 11. The adjusting device 11 controls the speed of the actuator 10, such as the rotation speed of the electric motor. The motion generated by the actuator 10 is transmitted by the drive shaft 9, the eccentric shaft 2 and the main shaft 3 to the supporting cone 4, wherein the cycle frequency of the supporting cone and the crushing blades 5 changes when the speed of the actuator is changed.

Preferably, the power input in the actuator 10 and/or the crushing force are determined continuously, and the rotation speed of the actuator 10 and thereby also the cycle frequency of the crushing cone 4 and the inner crushing blades 5 is controlled continuously. In this context, continuous determination and continuous control refers advantageously to determination and control several times a second. In one embodiment, the power input in the actuator 10 and/or the crushing force are determined continuously as a chain of events repeated at regular intervals, wherein the interval between the moments of single determinations may be 1 to 10 seconds. In a corresponding manner, in one embodiment, the rotation speed of the actuator 10 is continuously controlled in a chain of events repeated at regular intervals, wherein the intervals between the moments of single controls may be 1 to 10 seconds.

To minimize the effects of differences in the single measurements, it is possible to apply various operations of statistical mathematics. For example, it is possible to calculate the average for a given measurement period to be used as a basis for generating the data for the adjustment.

Figure 3:
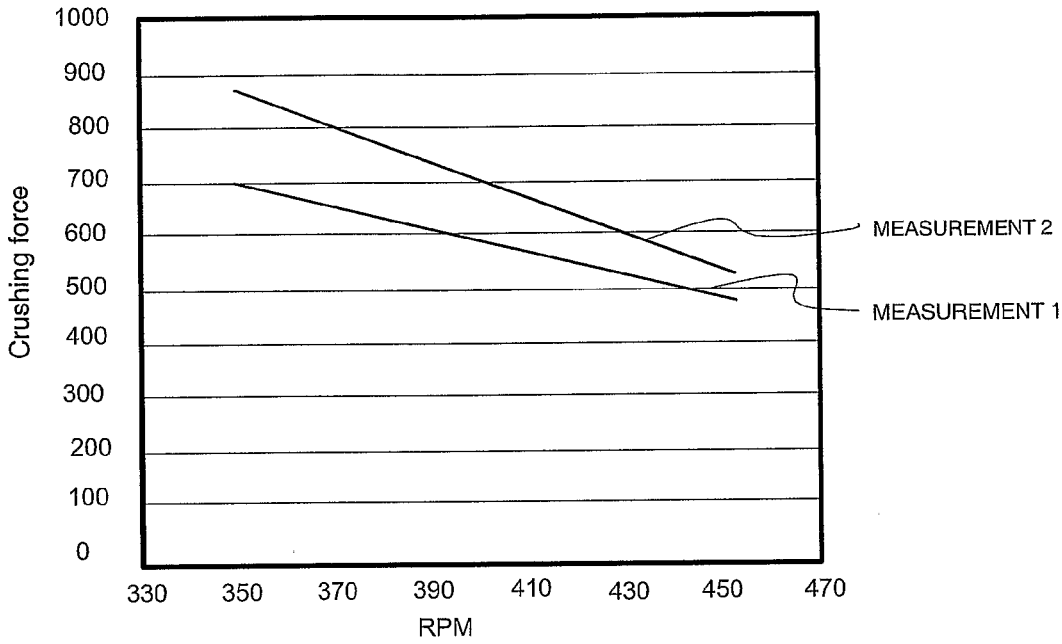
FIG. 3 shows graphs illustrating how the crushing force depends on the cycle frequency of the crushing cone.
Figure 4:
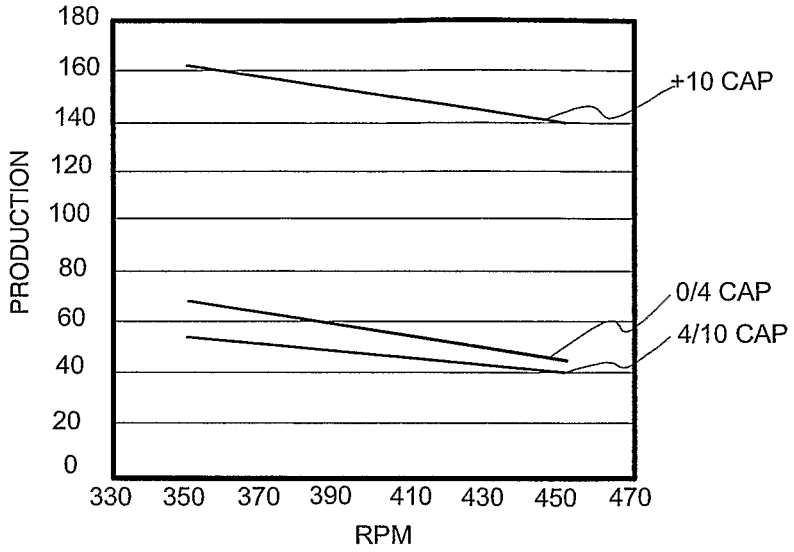
FIG. 4 shows graphs illustrating how the production of the crusher depends on the cycle frequency of the crushing cone.
Figure 5:
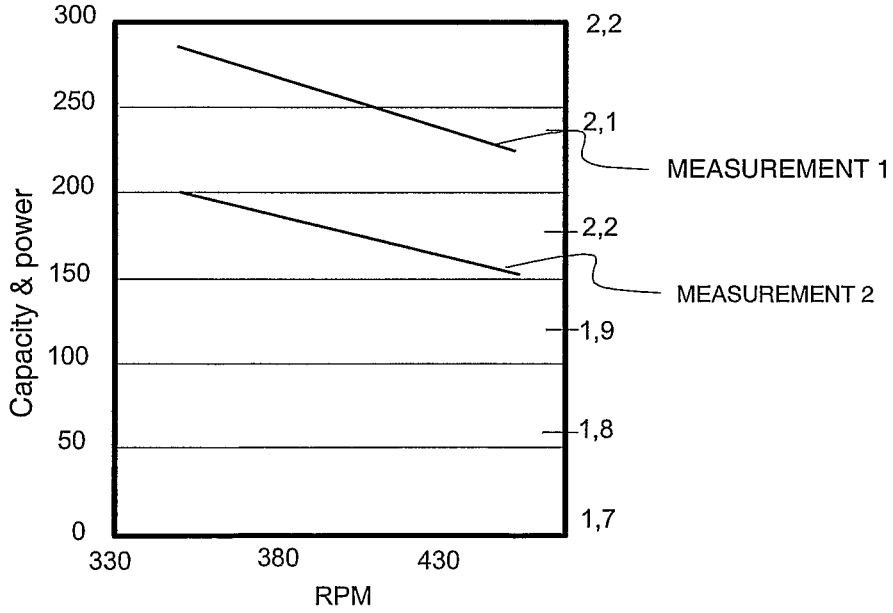
FIG. 5 shows graphs illustrating how the capacity of the crusher and the power input in the actuator depend on the cycle frequency of the crushing cone.

FIG. 3 shows, in an example, graphs illustrating how the crushing force depends on the cycle frequency of the crushing cone 4. The graphs of FIG. 3, as well as those of FIGS. 4 and 5, are based on crushing operations with a test apparatus, in which typical rock material was crushed to a grain size of about 4 to 10 mm. As can be seen from FIG. 3, the crushing force is reduced when the cycle frequency of the crushing cone 4 is increased. The correlation between the crushing force and the frequency is substantially linear.

FIG. 4 shows, in a corresponding manner, graphs illustrating how the production of the crusher depends on the cycle frequency of the crushing cone 4. The figure shows separate graphs for crushed material with grain sizes of smaller than 4 mm, 4 to 10 mm, and greater than 10 mm. From the figure, it can be seen that the production reduces as the cycle frequency of the crushing cone 4 increases. Also this correlation is substantially linear.

FIG. 5, in turn, shows combined graphs illustrating how the capacity of the crusher and the power input in the actuator 10 are dependent on the cycle frequency of the crushing cone 4. As can be seen from the figure, a high capacity is achieved but more power is required at low cycle frequencies. In a corresponding manner, less power is required but a lower capacity is obtained at higher frequencies. Also these graphs are substantially linear.

Figure 6:
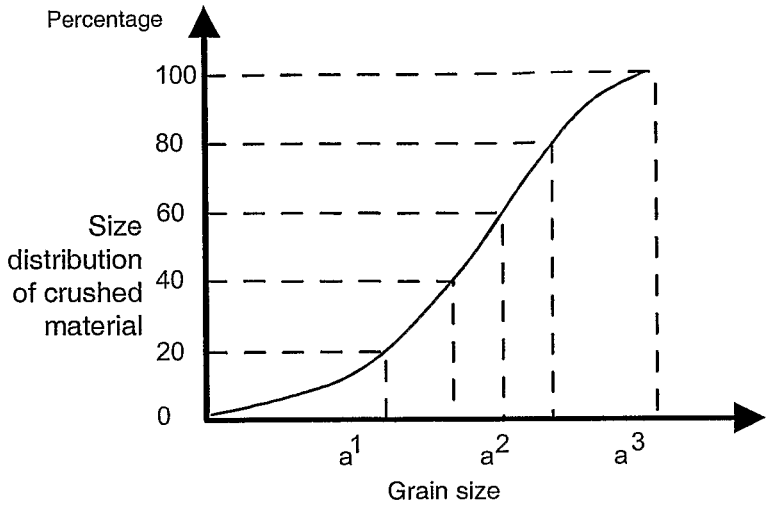
FIGS. 6 and 7 show the effect of the cycle frequency on the grain size distribution of the crushed material.
Figure 7:
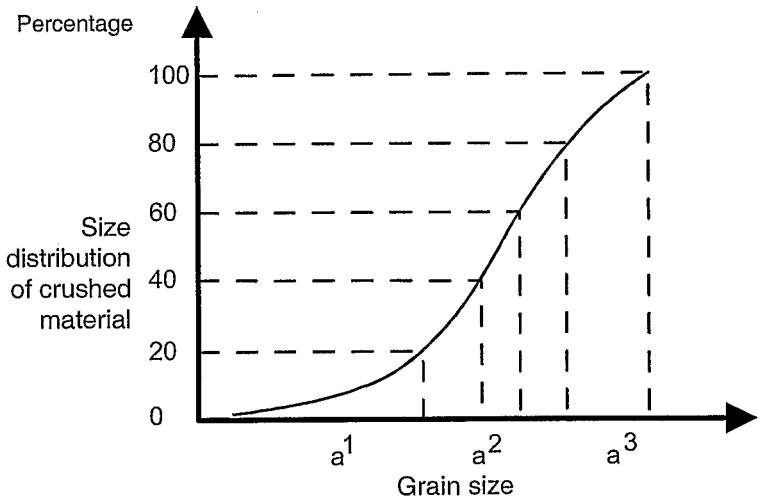

FIGS. 6 and 7 show how the frequency affects the grain size distribution of the crushed material, the other crushing conditions remaining constant. In FIG. 6, the frequency is high, and in FIG. 7, the frequency is lower. When the frequency is high, the crushed material comprises relatively more small-sized particles than when the frequency is lower.

Figure 8:
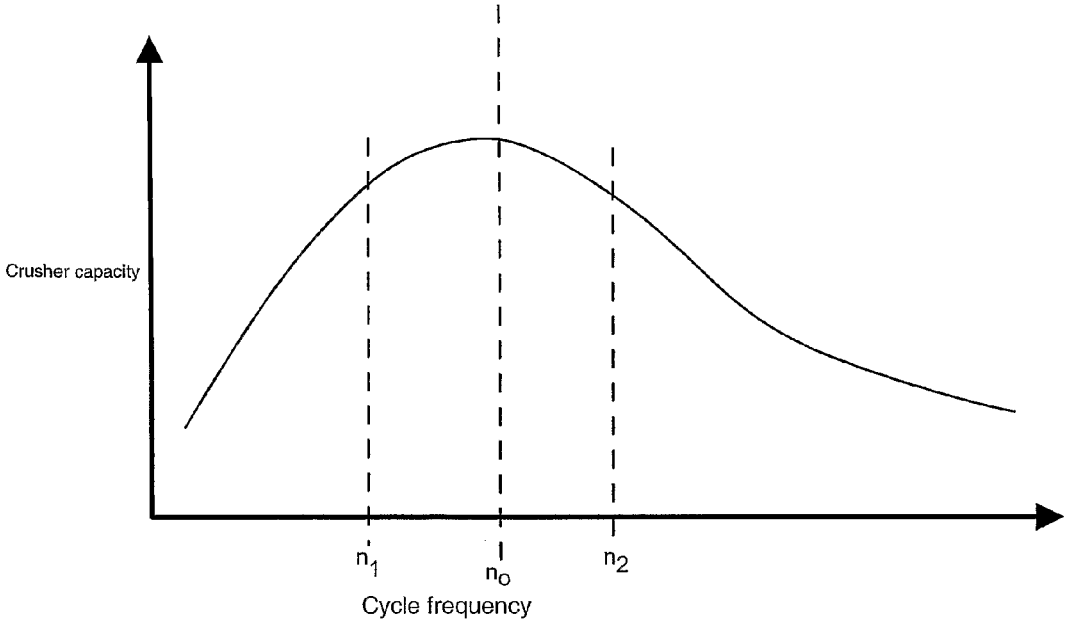
FIG. 8 shows another graph illustrating how the production of the crusher depends on the frequency of the crushing cone.

FIG. 8, in turn, illustrates the correlation between the capacity of the crusher and the cycle frequency of the crushing means 4. It can be seen from the figure that there is an optimum point $n_o$ at which the capacity of the crusher reaches a maximum. If necessary, the optimum point $n_o$ can be determined by experiments; in other words, by altering the frequency and simultaneously observing the capacity of the crusher. By examining the changes in the capacity, it is possible to determine the optimum point $n_o$. Furthermore, there is a frequency range $n_1$-$n_2$, within which the frequency should be in practice, for the crusher to function as desired.

As seen in the above-presented FIGS. 3 to 8, there is a cycle frequency for the crushing cone 4, at which the highest possible productivity and utilization degree are achieved with the power available. This cycle frequency depends, among other things, on the quality and the input rate of the material to be crushed. The cycle frequency is also affected by the grain size aimed at, as well as by the settings of the crusher.

In FIGS. 3 and 5, it can also be seen that the power input in the actuator 10 and the crushing force of the crusher behave essentially in a similar way when the cycle frequency of the crushing cone 4 changes. For this reason, the adjustment of the cycle frequency of the crushing cone 4 may be based solely on the power input in the actuator 10 or the crushing force. In one embodiment, the adjustment of the cycle frequency of the crushing cone 4 is based both on the power input in the actuator 10 and the crushing force of the crusher, wherein, in some cases, a better usability is achieved by monitoring several variables.

In many applications, the aim is to find the lowest possible cycle frequency of the crushing cone 4 with the power input of the crusher, because in this way, a high production of crushed material is typically achieved.

Figure 9:
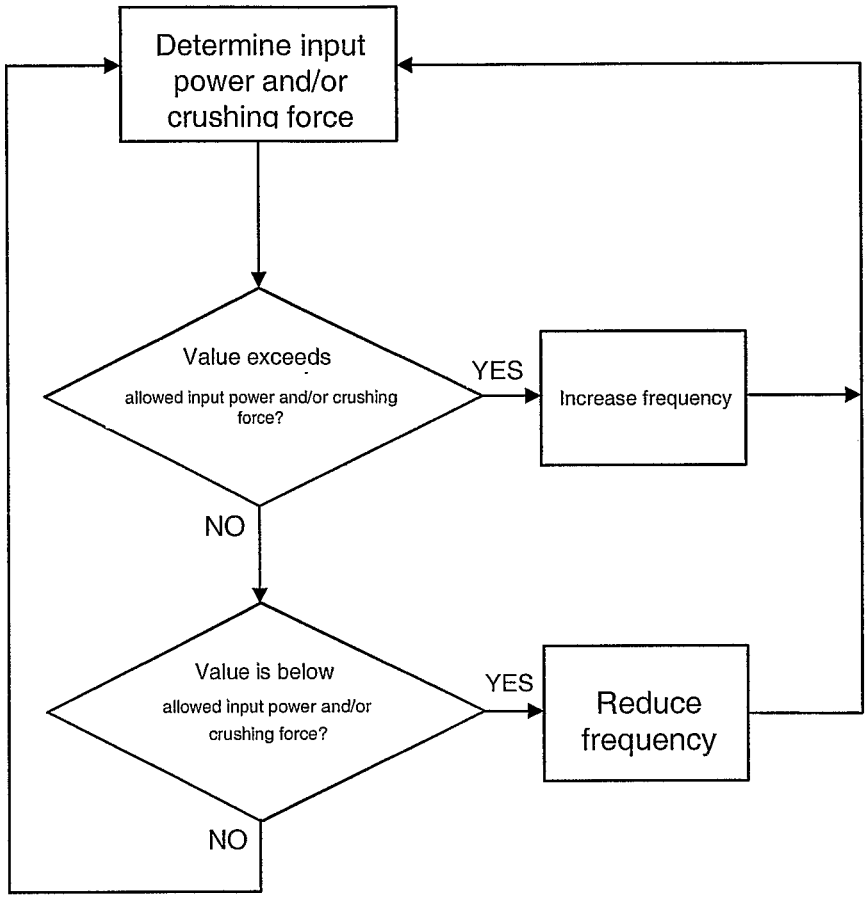
FIG. 9 shows a control method in a flow chart.

In one embodiment, the lowest cycle frequency is defined, at which the power input in the actuator 10 and/or the crushing force remain below the maximum level. After this, the cycle frequency is adjusted to the defined value. The principle of this kind of an approach is shown in the flow chart of FIG. 9.

In one embodiment, in turn, the highest available power of the actuator is determined, and the cycle frequency is adjusted in such a way that the crushing force and/or the power of the actuator 10 correspond substantially to said highest available crushing force and/or power.

In one embodiment, the data (limit value) indicating the highest available crushing force and/or power input in the actuator 10 is in a computer program. Thus, the measurement data is compared to the limit value by software, and the cycle frequency is adjusted on the basis of the comparison. The limit value can be determined for each application through trial or by inputting the desired limit value separately.

In the embodiment, in which the cycle frequency of the crushing cone 4 is adjusted continuously, it is possible to achieve a maximum production and utilization degree even if the quality and/or the quantity of the material to be crushed varied to a great extent within a short period of time.

The solution of adjusting the frequency of the crushing cone 4 can also be combined with other control arrangements, such as the adjustment of the settings. In one embodiment, changing the settings of the crushing blades will affect the power input in the actuator and/or the crushing force of the crushing unit 1. When the solution of adjusting the frequency of the crushing cone 4 is based on the power input in the actuator and/or the crushing force of the crushing unit 1, which are determined in a suitable way, the cycle frequency of the crushing cone is changed, if necessary, to correspond to the changed settings when the settings are changed.

In one embodiment, the frequency of the crusher is adjusted to adjust the particle size distribution of the crushed material. The particle size distribution of the crushed material is adjusted as desired by operating the crusher at various frequencies. For example, the frequency can be changed at short intervals between two or more values. As seen in FIGS. 6 and 7, when the frequency increases, the proportion of small particles in the crushed material increases, and in a corresponding manner, when the frequency reduces, the proportion of large particles in the crushed material increases. For producing crushed material with a high content of large particles, it is possible to reduce the frequency. In a corresponding manner, for producing crushed material with a high content of small particles, it is possible to increase the frequency. The adjustment is based on determining the particle size distribution of the crushed material produced by the crusher, by means of a suitable measuring device 13. On the basis of the measurement data from the measuring device 13, the control unit 14 generates the control data for achieving the desired particle size distribution. According to the control data from the control unit 14, the cycle frequency of the crushing means 4 is adjusted with a suitable adjusting device 11.

The above-described arrangement for adjusting the frequency of the crushing blade 4 is suitable for use in various cone crushers, such as, for example, crushers with a long stroke or a short stroke, as well as in other crushers, such as, for example, impact crushers and jaw crushers. The arrangement for adjusting the frequency is substantially independent of the stroke of the crusher, because the adjustment is advantageously based on the crushing force and/or the power input in the actuator 10, which are substantially not dependent on the stroke of the crusher.

By combining, in various ways, the modes and structures disclosed in connection with the different embodiments of the invention presented above, it is possible to produce various embodiments of the invention in accordance with the spirit of the invention. Therefore, the above-presented examples must not be interpreted as restrictive to the invention, but the embodiments of the invention may be freely varied within the scope of the inventive features presented in the claims herein below.

The invention claimed is:

1. A method for controlling a crusher comprising a crushing mechanism with a cycle and an actuator for moving the crushing mechanism, the method comprising:

defining a value of first data, the value indicating a power input in the actuator or a crushing force, and the value corresponding to a desired particle distribution of a crushed rock material produced by the crushing mechanism or a desired quantity of the crushed rock material produced by the crushing mechanism;

crushing the rock material by operating the crushing mechanism;

measuring an actual value of the data; and substantially and continuously adjusting a cycle frequency of the crushing mechanism during the crushing in order to change the measured value towards the defined value;

wherein the crushing mechanism comprises:

an eccentric shaft having an inner hole;

a main shaft fitted within the inner hole of the eccentric shaft;

a supporting cone configured to oscillate;

an inner crushing blade mounted to the supporting cone;

a frame surrounding the supporting cone; and an outer crushing blade mounted on the frame;

wherein when the eccentric shaft is rotated, the supporting cone is entrained in an oscillating motion; and a gap between the inner crushing blade and the outer crushing blade varies at each point during the cycle.

2. The method according to claim 1, further comprising:

adjusting the cycle frequency within a cycle range in order to achieve the desired particle distribution without exceeding any of the defined values.

3. The method according to claim 1, further comprising:

adjusting the cycle frequency within a cycle range in order to achieve a maximum quantity without exceeding the defined value.

4. The method according to claim 1, wherein the cycle frequency of the crushing mechanism is changed by a frequency converter affecting a rotational speed of the actuator.

5. The method according to claim 1, further comprising:

determining a highest available power input in the actuator; and adjusting the cycle frequency of the crushing mechanism in such a way that the power input in the actuator substantially corresponds to the highest available power.

6. The method according to claim 1, further comprising:

determining a highest available crushing force; and adjusting the cycle frequency of the crushing mechanism in such a way that the crushing force substantially corresponds to the highest available crushing force.

7. The method according to claim 6, wherein:

by increasing the cycle frequency, relative amounts of small particles in the crushed rock material are increased; and by reducing the cycle frequency, relative amounts of large particles in the crushed rock material are increased.

8. A crusher for crushing a rock material, the crusher comprising:

a crushing mechanism with a cycle, the crushing mechanism comprising:

an eccentric shaft having an inner hole;

a main shaft fitted within the inner hole of the eccentric shaft;

a supporting cone configured to oscillate;

an inner crushing blade mounted to the supporting cone;

a frame surrounding the supporting cone; and an outer crushing blade mounted on the frame;

wherein when the eccentric shaft is rotated, the supporting cone is entrained in an oscillating motion; and a gap between the inner crushing blade and the outer crushing blade varies at each point during the cycle;

an actuator for moving the crushing mechanism;

a control unit that defines a value of first data, the value indicating a power input in the actuator or a crushing force, and the value corresponding to a desired particle distribution of the crushed rock material produced by the crusher or a desired quantity of the crushed rock material produced by the crusher;

a measuring device that measures the actual value of the data; and an adjusting device that substantially and continuously adjusts the cycle frequency of the movable crushing mechanism during the crushing in order to change the measured value towards the defined value.

* * * * *